US005463840A

United States Patent [19]

Bailer

[11] Patent Number: 5,463,840

[45] Date of Patent: Nov. 7, 1995

[54] SYSTEM FOR SUPPLYING LITERATURE INSERTS TO A CARTON-PACKING MACHINE

[75] Inventor: Rudolf Bailer, Laupheim, Germany

[73] Assignee: Uhlmann Pac-Systeme GmbH & Co. KG, Laupheim, Germany

[21] Appl. No.: 229,324

[22] Filed: Apr. 18, 1994

[30] Foreign Application Priority Data

May 4, 1993 [DE] Germany ..... 43 14 631.7

[51] Int. Cl.[6] ..... B65B 63/04

[52] U.S. Cl. ..... 53/117; 53/569; 493/420

[58] Field of Search ..... 53/117, 569, 284.3, 53/238, 542, 206; 493/420; 271/246, 245, 189

[56] References Cited

U.S. PATENT DOCUMENTS

| | | | |
|---|---|---|---|
| 3,797,196 | 3/1974 | Harbison | 53/117 |
| 4,502,262 | 3/1985 | Reim et al. | 53/238 |
| 4,852,334 | 8/1989 | Auerbach | 53/284.3 |
| 4,903,461 | 2/1990 | Dimur | 53/260 |
| 5,135,352 | 8/1992 | Scata et al. | 53/542 |
| 5,235,796 | 8/1993 | Campbell, III et al. | 53/542 |
| 5,280,694 | 1/1994 | Malow | 53/542 |

FOREIGN PATENT DOCUMENTS 3118209 1/1983 Germany .

*Primary Examiner*—John Sipos
*Assistant Examiner*—Ed Tolan
*Attorney, Agent, or Firm*—Herbert Dubno; Andrew Wilford

[57] ABSTRACT

A main conveyor for conveying a succession of orders in a main direction past a transfer location is associated with an upwardly open holder pocket at the transfer location defining a vertical transfer plane. A plurality of openable transfer clips on an endless conveyor element are displaceable past the pocket with the clips moving vertically upward in the transfer plane as they pass the pocket. A pair of belts having juxtaposed stretches and spanned over a pair of downstream rollers spaced to one side of the transfer plane immediately above the pocket drop literature packs one after the other from between the rollers and belts into the pocket. A cam arrangement opens the clips as they approach the pocket and closes them generally when they reach the pocket for gripping the packs and lifting them out of the pocket.

7 Claims, 4 Drawing Sheets

SYSTEM FOR SUPPLYING LITERATURE INSERTS TO A CARTON-PACKING MACHINE

FIELD OF THE INVENTION

The present invention relates to packaging. More particularly this invention concerns a system for supplying literature inserts to a carton-packing machine.

BACKGROUND OF THE INVENTION

In a shipping department, for instance of a warehousing operation that assembles and ships orders, it is standard to include with each order a substantial literature insert. The orders themselves are assembled and moved along on a transport belt in individual piles of articles, mailing tubes, bottles, blister packs, or the like each constituting a single order. The literature-inserting apparatus puts a literature pack, typically all folded together, on the belt in front of each such pile so that as same is pushed into a carton the literature is pushed in first.

In the standard system described in German patent document 3,118,209 the literature is prepared by a folding machine which folds up the literature packs and delivers the thus produced folded literature inserts one at a time by means of a pair of belts to a transfer location. The belts have stretches running parallel to and in contact with each other to define a travel path. The folded literature packs travel to the downstream end of this path, where the two belts pass over rollers that deflect them oppositely away from each other at the transfer location. Here the folded literature inserts are gripped by transfer clips as they emerge from between the belts at the downstream end of the path. The transfer clips, which are carried on a transfer conveyor, then pass off the literature inserts to the main conveyor belt on which the orders are moving, with of course everything synchronized to put one such insert with each order.

The folding-machine belts normally move somewhat faster than the transfer conveyor and the literature inserts emerge from the folding machine at the transfer location in a direction that corresponds to the direction the transfer clips are moving in as they pass the transfer location. The clips are open backward in their direction and the higher speed of the folding-machine belts cause the inserts to be pushed from behind into these transfer clips. This requires that the operation of the folding machine and of the transfer conveyor, which is set up to open and close the clips as they pass the transfer location, be extremely accurately synchronized with each other. The literature packs must be delivered at exactly the right time to the transfer location or the handoff is missed and/or the machine is jammed. Thus if a literature pack slips as it is being transported, the whole system can be brought down.

Another disadvantage is that it is difficult to crowd all the necessary structure in at the transfer location. The inserts move in a transfer plane as they are picked up by the transfer clips. This plane must inherently be laterally offset somewhat from and parallel to the path of the main order-conveying belt, and the offset is at least equal to the diameter of one of the downstream deflecting rollers of the folding machine. Positioning all this structure at this location is a problem.

OBJECTS OF THE INVENTION

It is therefore an object of the present invention to provide an improved literature-inserting apparatus for a packing system.

Another object is the provision of such an improved literature-inserting apparatus for a packing system which overcomes the above-given disadvantages, that is which surely and accurately hands off folded literature packs to clips which can transfer them to individual orders.

A further object is to provide such a literature-inserting apparatus that is fairly simple and that ensures perfect handoff of the literature inserts with few synchronization problems.

SUMMARY OF THE INVENTION

A main conveyor for conveying a succession of orders in a main direction past a transfer location is associated according to the invention with an upwardly open holder pocket at the transfer location defining a vertical transfer plane. A plurality of openable transfer clips on an endless conveyor element are displaceable past the pocket with the clips moving vertically upward in the transfer plane as they pass the pocket. A pair of belts having juxtaposed stretches and spanned over a pair of downstream rollers spaced to one side of the transfer plane immediately above the pocket drop literature packs one after the other from between the rollers and belts into the pocket. A cam arrangement opens the clips as they approach the pocket and closes them generally when they reach the pocket for gripping the packs and lifting them out of the pocket.

Thus with this invention the folding apparatus drops the literature packs into the pocket and, as the clips sweep by them, they are picked up and then transferred to the respective orders. The folding apparatus and transfer system need not be perfectly synchronized, so long as a literature pack is ready in the holder when a clip arrives. In other words the information packs can be dropped into the holder as soon as it is clear, so that there is some leeway in the timing.

Furthermore since the folding apparatus rollers are both to the same side of the transfer plane, this plane can coincide with the plane in which the clips move, rather than being offset therefrom. This greatly simplifies movement inside the machine. In addition the folding apparatus is positioned mainly above the packing machine because it drops the articles down into the holding pocket, so this folding apparatus is in a location that is easy to load and service.

According to a feature of this invention the holder pocket is formed by a downstream plate substantially lying on and parallel to the transfer plane and an upstream plate extending at an acute angle to the transfer plane and having an upper edge generally at the downstream rollers. The downstream plate has an upper edge well above the rollers and the belt stretches extend at a small acute angle to the transfer plane immediately upstream of the downstream rollers. As a result the information packs are dropped smoothly into the holder pocket, whence they are picked up by the clips. More particularly the downstream rollers are rotatable about axes parallel to each other and to the transfer plane and one of the downstream rollers is wholly above the other of the downstream rollers and both downstream rollers are tangent to a plane spaced from and parallel to the transfer plane. The literature packs are therefore not folded or treated roughly at all, ensuring they stay together.

In accordance with further features of the invention the holder pocket is formed by a downstream plate substantially lying on and parallel to the transfer plane and an upstream plate extending at an acute angle to the transfer plane and having an upper edge formed with a cutout receiving the other lower downstream roller. The stretches extend at a small acute angle to the transfer plane immediately upstream of the downstream rollers. The acute angle between the downstream plate and the transfer plane is smaller than the acute angle between the stretches and the transfer plane.

To ensure synchronization, the system is provided with a blocking element displaceable between a position blocking movement of the packs along the path and a position permitting such movement for dropping the packs from the belts at regular intervals.

BRIEF DESCRIPTION OF THE DRAWINGS

The above and other objects, features, and advantages will become more readily apparent from the following description, reference being made to the accompanying drawing in which.

SPECIFIC DESCRIPTION

Figure 1:
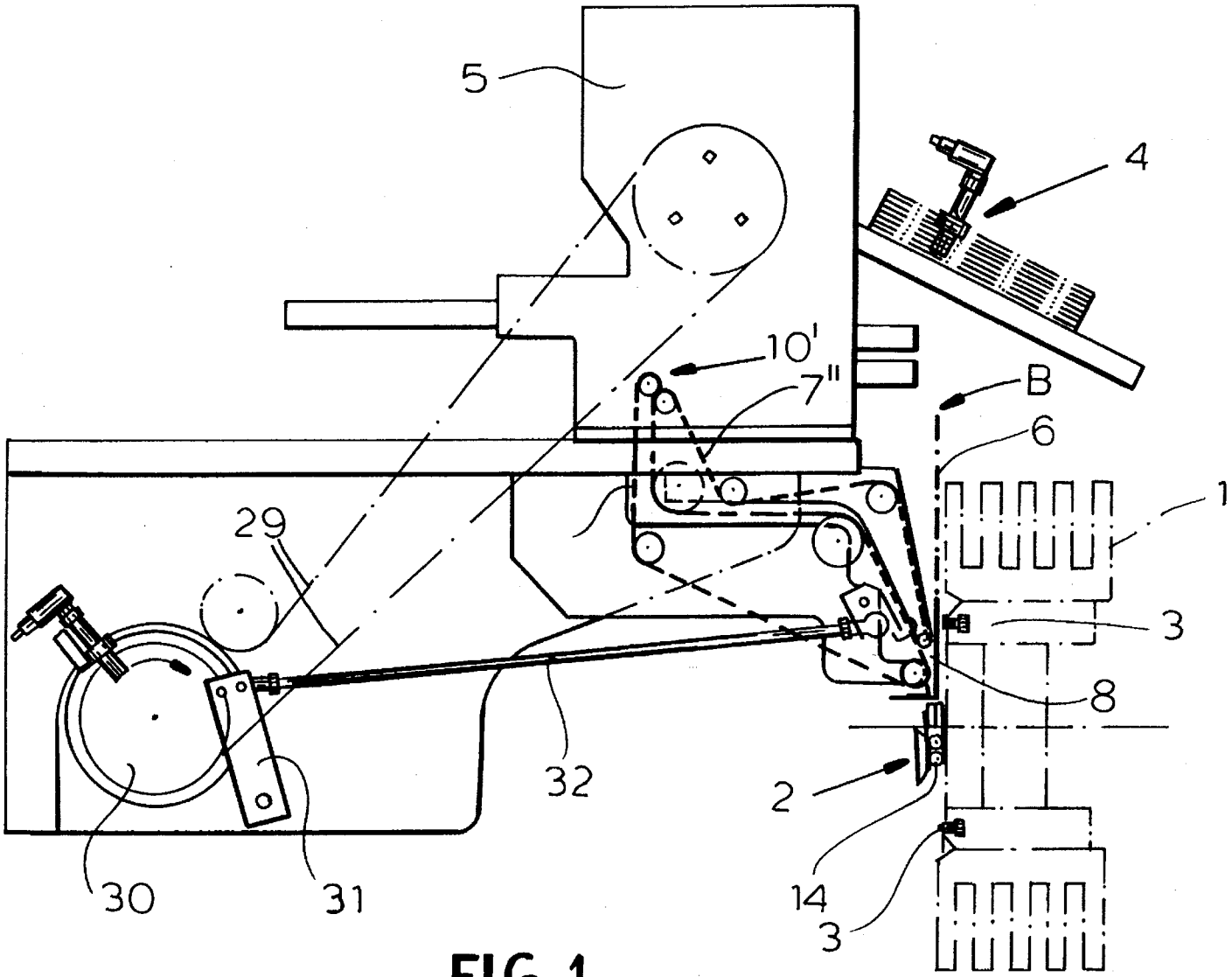
FIG. 1 is a small-scale partly diagrammatic side view of the apparatus of this invention.

As seen in FIG. 1 a packing machine has a main conveyor 1 that displaces a succession of orders in a main transport direction 18' (FIG. 3) perpendicular to the plane of the view in FIG. 1. A folding machine 5 takes literature packs from a supply 4, folds them into strip inserts 6, and feeds them to an upstream end 10' of a conveyor path defined between belts 7' and 7". This path ends at its downstream end 8 at a pair of rollers 9' and 9" shown in FIG. 2. The belts 7' and 7" flank support plates 11 which are provided with rollers 10 over which these belts 7' and 7" are spanned.

Figure 2:
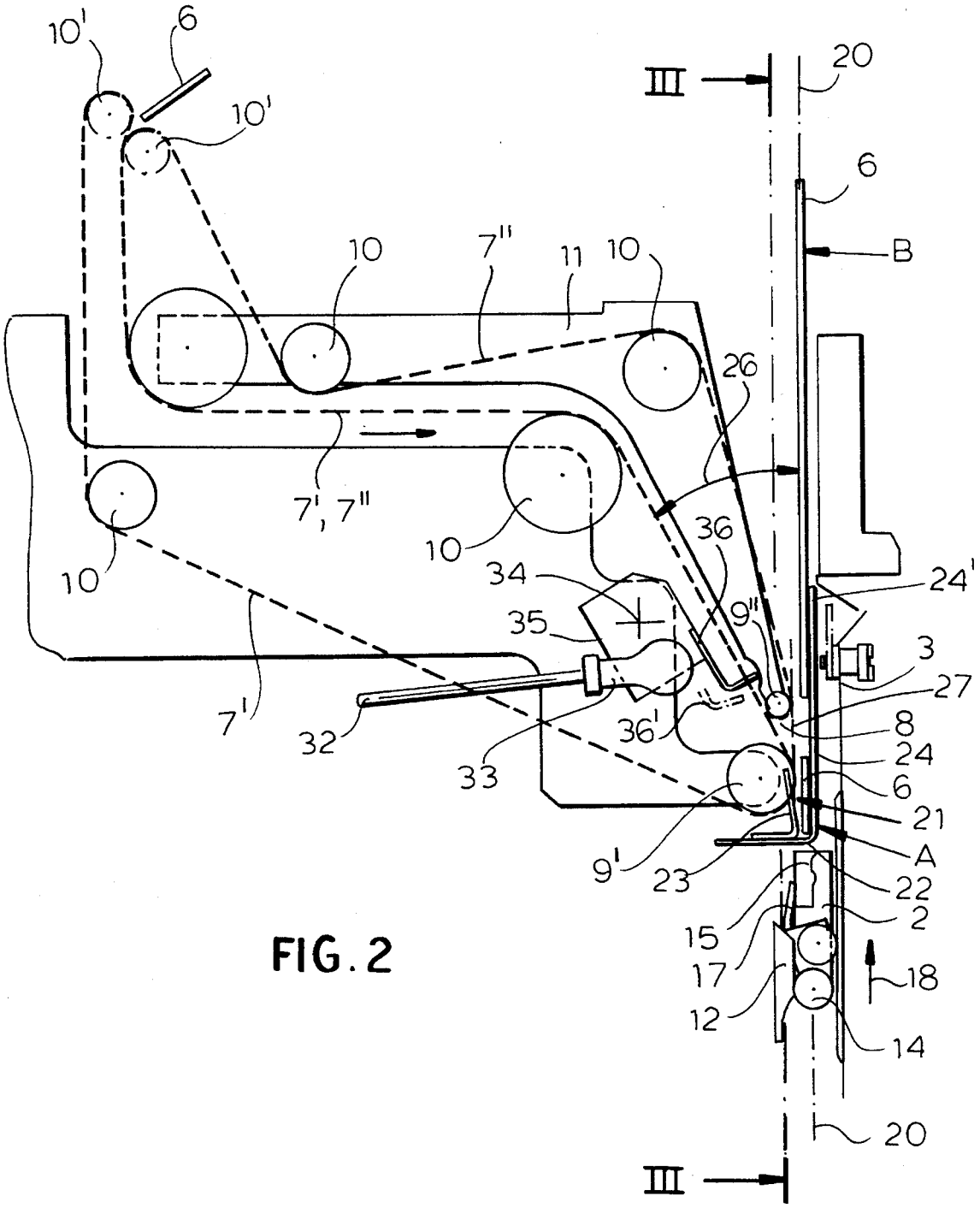
FIG. 2 is a larger-scale view of a detail of FIG. 1.

The folding machine 5 is connected via a belt 29 to a cam wheel 30 that periodically deflects a lever 31 connected to a rod 32 having a head 33 pivoted on a plate 35 itself pivoted at 34 on the frame 11. This plate 35 in turn carries an angled finger 36 that can move as shown in FIG. 2 between the solid-line position blocking movement of the literature inserts 6 out from between the belts 7' and 7" and a dot-dash position 36' permitting them to exit. This mechanism 29--36 therefore ensures that the literature inserts 6 exit at exactly controlled intervals from the downstream end 8 that defines the transfer location.

Figure 3:
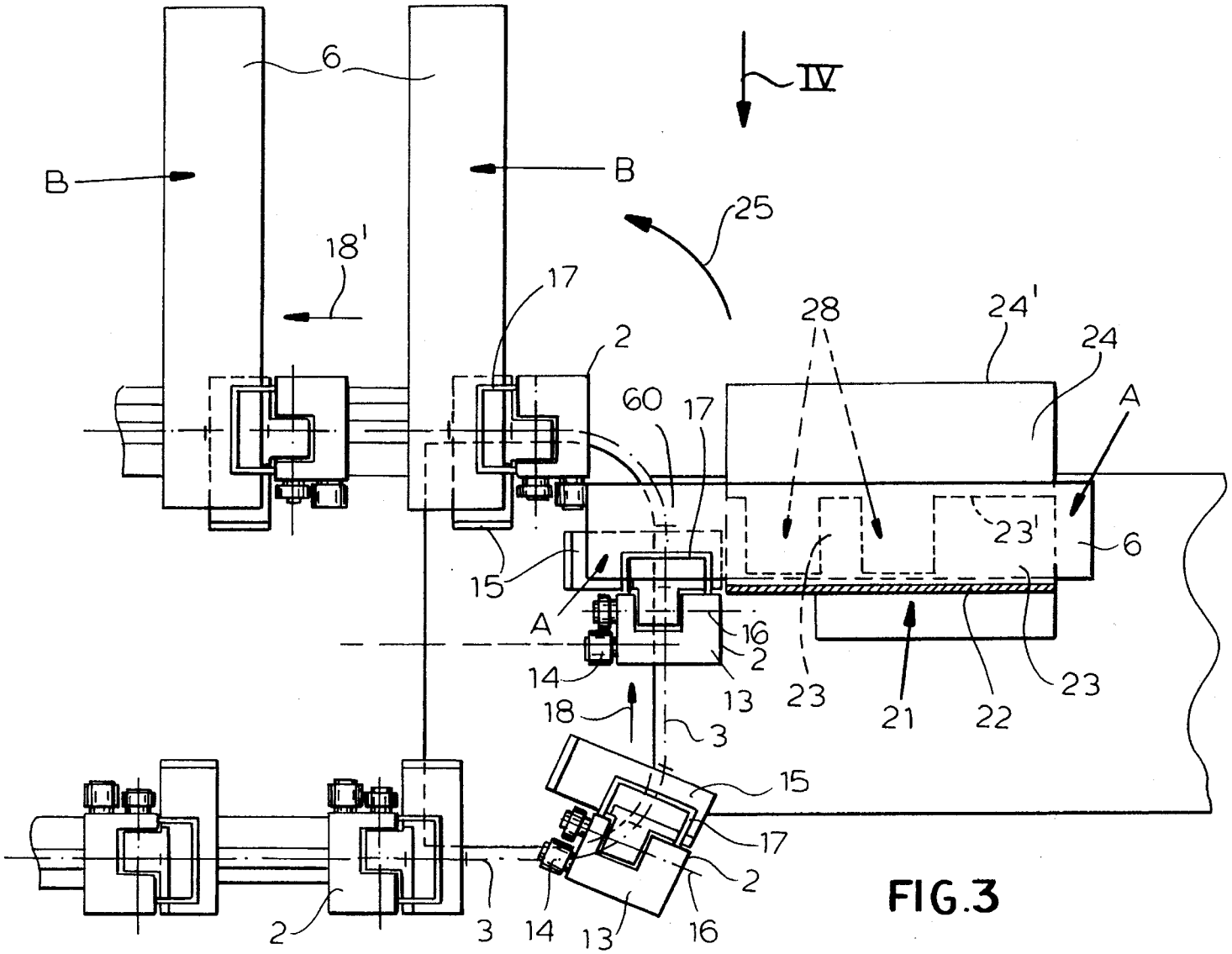
FIG. 3 is a section taken along line III—III of FIG. 2.
Figure 4:
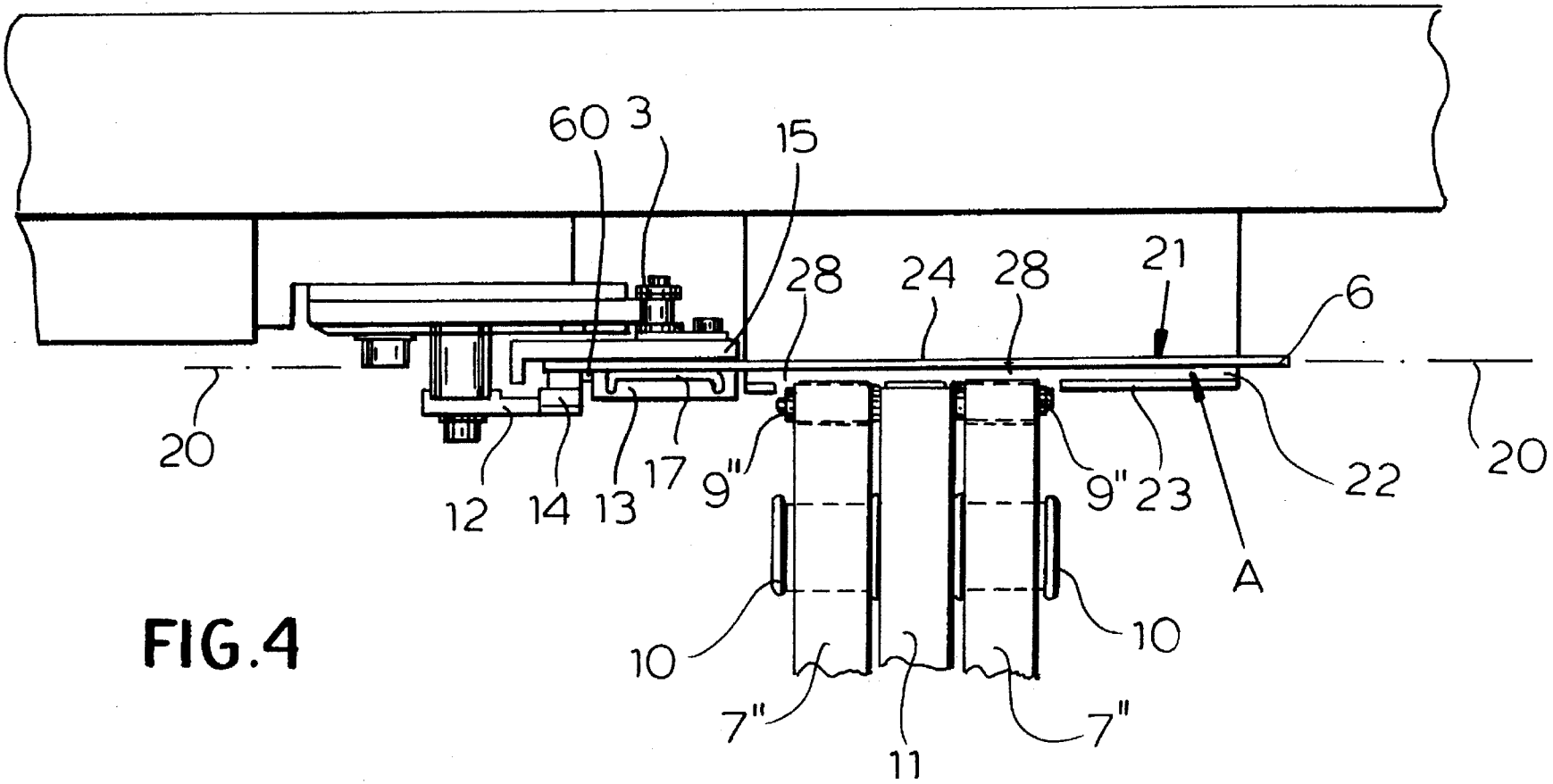
FIG. 4 is a view in the direction of arrow IV of FIG. 3.

The literature inserts 6 are picked up by clips 2 carried on a continuously moving chain 3 so that as seen in FIG. 3 the clips 2 are first moved up past the transfer station 8 in a direction 18, then are swung through an arc 25, and then move in the main transport direction 18'. Each clip 2 comprises a plate 15 fixed on the belt 3 and extending perpendicular to it, and an arm 13 pivoted at 16 and having on one end a roller 14 and on its other end a wire arm 17 that can engage against the plate 15. An unillustrated torque spring normally presses the wire arm 17 against the plate 15 and the rollers 14 ride as they near the location 8 on a cam 12 (see FIGS. 2 and 4) to open up the clip 2 so that it is open downstream in the directions 18 and 18'.

The transfer from the folding machine 5 to the clips 2, which is the subject of the instant invention, is facilitated by having the folding machine 5 deposit the folded literature inserts 6 into a holder 21 formed between a short upstream or inner plate 23 and a taller downstream or outer plate 24 having lower ends forming a floor 22. The short upstream plate 23 has an upper edge 23' that lies below the upper extent of the deflecting rollers 9' and is in fact formed with cutouts 28 that accommodate these rollers 9'. This plate 23 is angled to the vertical somewhat back from a vertical transfer plane 20. The taller downstream plate 24 has an upper edge 24 that is well above the uppermost smaller-diameter deflecting roller 9" and is vertical and parallel to the plane 20, which is virtually against it.

The holder 21 is therefore formed as an upwardly open slot to which the folded literature insert 6 is delivered with an end portion 60 projecting past the plates 23 and 24 into the path of the clips 2. The belts 7' and 7" open at the location 8 at an angle 26 of about 18° while the plate 23 forms a somewhat smaller angle with the plate 24. The two rollers 9' and 9" are tangent to a vertical plane 27 that is slightly offset from the plane 20 and, as mentioned above, the roller 9" is spaced above the roller 9'.

Thus as a folded literature insert 6 is expelled from between the belts 7' and 7" at the location 8, it will drop down between the plates 23 and 24 of the holder 21. Since the insert 6 will lose contact with the belt 7" before it loses contact with the belt 7', it will be flipped into a position standing virtually perfectly vertically along the plane 20 against the plate 24. The lower output-end roller 9' and the respective belt 7' project slightly into the pocket or holder 21 to urge the folded insert pack 6 downward therein.

Meanwhile as shown in FIG. 3 as the next clip 2 moves along its path in the vertical direction 18, the cam 12 pushes its roller 14 and pulls back the wire 17 just before the clip 2 comes up behind the just dropped insert 6. As the clip 2 moves forward, with the wire 17 to one side and the plate 15 to the other side of the insert 6, the roller 14 falls off the cam 12 and the clip 2 closes, tightly gripping the extending end portion 60 of the insert 6. Then as the clip 2 moves around the arc 25 the insert 6 is swung from its recumbent position A to a vertical position B, whence it is passed to the order conveyor 1.

I claim:

1. In combination:

a main conveyor for conveying a succession of orders in a main direction past a transfer location;

an upwardly open holder pocket at the transfer location defining a vertical transfer plane and formed by an outer plate substantially lying on and parallel to the transfer plane and an inner plate extending at a small acute angle to the transfer plane;

a plurality of openable transfer clips displaceable past the pocket with the clips moving vertically upward in the transfer plane as they pass the pocket;

a pair of rollers spaced to one side of the transfer plane immediately above the pocket, the inner plate having an upper edge generally at the rollers;

folding means including a pair of belts having juxtaposed stretches and spanned over the rollers for making folded literature packs, conveying the folded literature packs while compressed between the belts to the rollers, and dropping the folded literature packs one after the other from between the rollers and belts into the pocket while maintaining the packs compressed and preventing them from unfolding, the plates being sufficiently close to prevent the packs they hold from unfolding; and control means for opening the clips as they approach the pocket and closing them generally when they reach the pocket for gripping the packs and lifting them out of the pocket.

2. The combination defined in claim 1 wherein the outer plate has an upper edge well above the rollers.

3. The combination defined in claim 1 wherein the stretches extend at a small acute angle to the transfer plane immediately upstream of the rollers.

4. The combination defined in claim 3 wherein the rollers are rotatable about axes parallel to each other and to the transfer plane and one of the rollers is wholly above the other of the rollers and both rollers are tangent to a plane spaced from and parallel to the transfer plane.

5. The combination defined in claim 4 wherein the downstream plate has an upper edge formed with a cutout receiving the other roller.

6. The combination defined in claim 5 wherein the stretches extend at a small acute angle to the transfer plane immediately upstream of the rollers, the acute angle between the outer plate and the transfer plane being smaller than the acute angle between the stretches and the transfer plane.

7. The combination defined in claim 1, further comprising means operating synchronously with the folding means and including a blocking element displaceable between a position blocking movement of the packs along the path and an unblocking position permitting such movement, and actuating means coupled between the blocking element and the folding means for periodically moving the blocking element into the unblocking position and thereby dropping the packs from the belts at regular intervals.

* * * * *